United States Patent [19]

Vadnais

[11] Patent Number: 4,546,906

[45] Date of Patent: Oct. 15, 1985

[54] CHUCK VALVE DISPENSING MEANS

[76] Inventor: Kenneth Vadnais, 20322 Beatrice, Livonia, Mich. 48152

[21] Appl. No.: 544,718

[22] Filed: Oct. 24, 1983

[51] Int. Cl.[4] ..... B65D 47/00

[52] U.S. Cl. ..... 222/502; 222/541

[58] Field of Search ..... 222/502, 503, 507, 509, 222/511, 522, 525, 531, 532, 541, 559

[56] References Cited

U.S. PATENT DOCUMENTS

| | | | |
|---|---|---|---|
| 1,327,067 | 1/1920 | Starcke | 222/525 |
| 2,135,237 | 11/1938 | Lewis et al. | 222/507 |
| 2,309,895 | 2/1943 | Griffith | 222/502 |
| 2,665,826 | 1/1954 | Mahoney | 222/502 |
| 2,901,152 | 8/1959 | Wahnisiedler | 222/502 |
| 2,981,449 | 4/1961 | Perkins | 222/541 |
| 3,232,499 | 2/1966 | Esposito | 222/532 |

*Primary Examiner*—H. Grant Skaggs
*Attorney, Agent, or Firm*—James M. Deimen

[57] ABSTRACT

A dispensing valve and nozzle combination for dispensing cartridges filled with viscous material such as caulking, sealant or glue. The valve and nozzle comprise a substantially cylindrical cap terminating in a conical nozzle and a hollow substantially cylindrical valve body terminating in a plurality of integral segments nested together within the conical nozzle of the cap. The segments superficially resemble the segments within a common drill chuck and open and close to provide a sealable passage for the dispensed material. The opening of the segments as the valve is opened permits relatively unimpeded straight through flow of very viscous material, nevertheless permitting the valve to be sealingly closed with little or no dispensable material clinging to the valve nozzle or exposed to the air.

The valve cap and nozzle is trimmable on the bias to permit a bead to be put down in the normal manner. The bias trim or opening size of the nozzle can be selected within limits for a large or small bead and the valve is adjustable between the closed position and the trimmed open position.

19 Claims, 9 Drawing Figures

CHUCK VALVE DISPENSING MEANS

BACKGROUND OF THE INVENTION

The invention pertains to the field of valves and nozzles for the dispensing of viscous materials and, in particular, to the dispensing of viscous materials from cartridges typically used in caulking guns. While particularly suited to the dispensing of very viscous and difficult to dispense materials, the new valve and nozzle combination is not limited thereto but is suitable for dispensing a wide variety of materials not necessarily of high viscosity.

The typical cartridge type of dispenser for caulking, sealant or glue comprises a cardboard tube with one metal end sealingly attached to the cardboard tube. A plastic nozzle, snout or applicator tip extends from the metal end. As manufactured and sold the applicator tip is sealed. An additional internal aluminized plastic seal covers the opening through the metal end into the cartridge tip. The other end of the tube includes an internally mounted diaphragm seal or cover that is engageable by the caulking gun plunger to apply pressure to the material in the tube and thereby expel the material through the applicator tip.

Before applying pressure to the diaphragm, the tapered end of the applicator tip is opened and trimmed by the user to provide the desired opening diameter and a nail or other sharp pointed object is inserted to pierce the aluminized plastic seal.

Unfortunately, once the cartridge is opened, the applicator tip or nozzle can not be properly closed or resealed in a manner that prevents air from entering and causing the material in the applicator tip to harden. Since the applicator tip is tapered, the slug of hardened material becomes difficult to expel. Typically, increased force applied to the plunger causes the cardboard to burst with the result that the material can no longer be properly dispensed from the cartridge.

A cap to cover the trimmed applicator tip can be applied as provided with some cartridges, however, the cap is removed during use and can easily be mislaid. The separable cap also permits air to be trapped at the tip thereby permitting hardening of material at the tip to ensue.

Valves such as that disclosed in U.S. Pat. No. 2,859,932 can be used to control the passage of liquids. Such valves provide a tortuous path for a liquid or a somewhat viscous material. Where the viscous material is very viscous, the tortuous path can greatly impede the flow of the material. Secondly, such a valve does not provide a straight through path and therefore if applied as a factory installed permanent part of the cartridge, the aluminized plastic seal cannot be utilized because a nail can not be put through the valve to break the seal.

With a view toward overcoming the problems noted above, the applicant has developed the valve disclosed and described below.

SUMMARY OF THE INVENTION

The invention comprises a two piece valve and nozzle combination for dispensing cartridges filled with viscous material such as caulking, sealant or glue. The valve and nozzle comprise a substantially cylindrical cap terminating in a conical nozzle and a hollow substantially cylindrical valve body terminating in a plurality of segments nested together within the conical nozzle of the cap. The segments superficially resemble the segments within a common drill chuck and open and close to provide a sealable passage for the dispensed material. The cap and body, however, include a spline engagement therebetween to prevent relative rotation therebetween. Thus, the valve and nozzle combination is opened and closed by axial sliding movement of the cap on the body.

The opening of the segments as the valve is opened permits relatively unimpeded straight through flow of very viscous material, nevertheless permitting the valve to be sealingly closed with little or no dispensable material clinging to the valve nozzle or exposed to the air.

As manufactured and assembled the valve and nozzle combination is completely sealed at the tip by an enclosed cap tip. The nozzle size is determined by the location on the conical portion of the cap where the user slices off the tip of the cap and simultaneously the tips of the segments. The valve remains tightly sealed, however, in this condition. Only when the cap is moved outwardly and axially do the segments separate and a nozzle passage form for the dispensing of material.

The straight through flow path of the valve and nozzle combination is particularly advantageous for the dispensing of very viscous material because the tortuous passageways through conventional valves are virtually eliminated and therefore the resistance to flow greatly reduced.

DESCRIPTION OF THE PREFERRED EMBODIMENT

Figure 1:
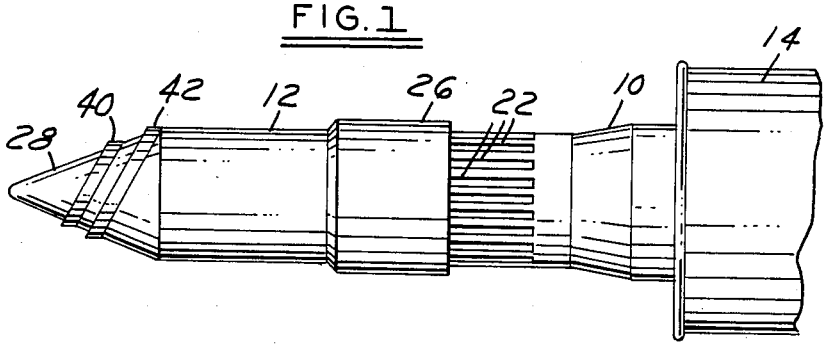
FIG. 1 is a side view of an uncut dispensing valve mounted on a cartridge.
Figures 2, 3, 6, 7, 8:
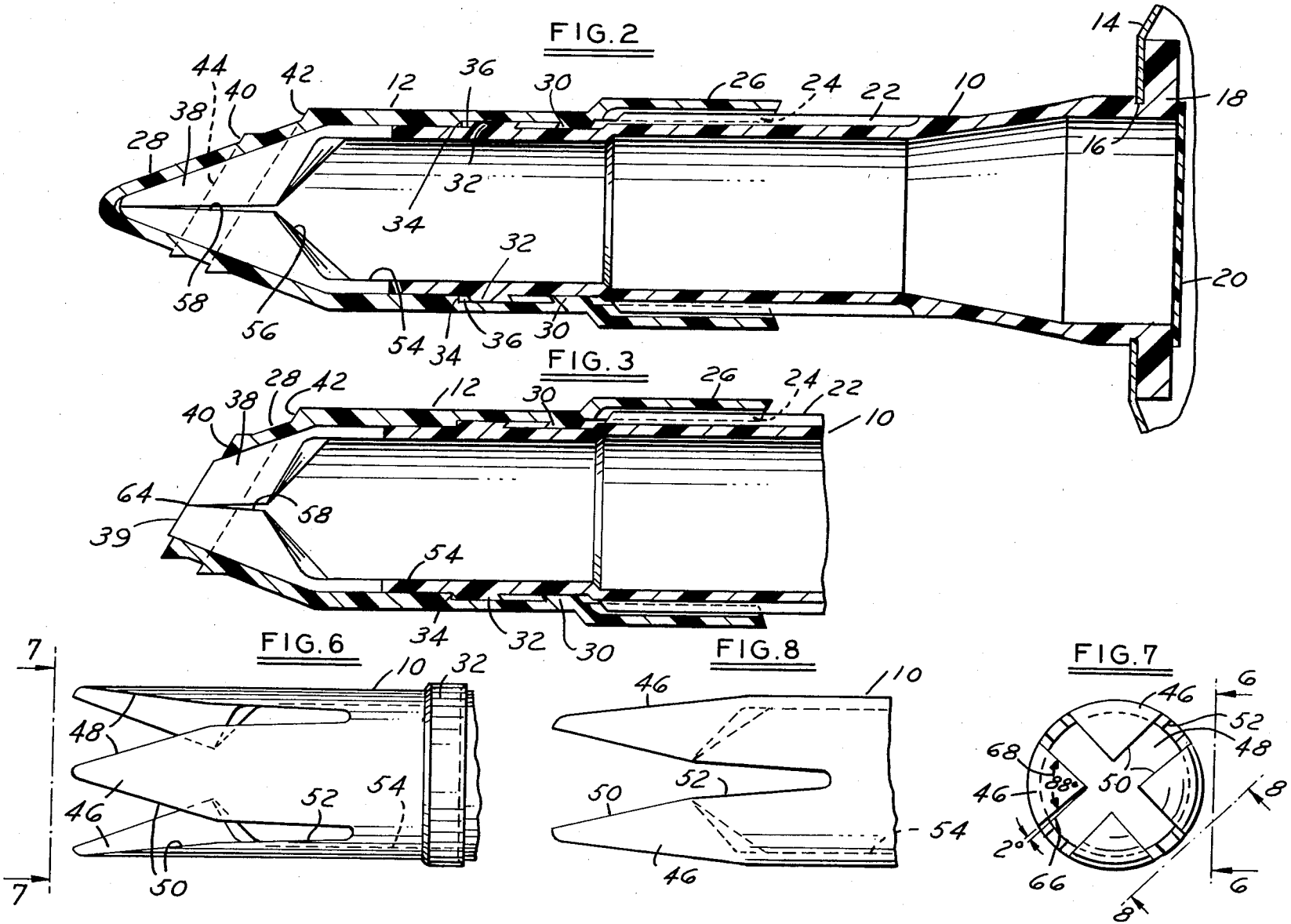
FIG. 2 is a side cross section of the uncut dispensing valve.
FIG. 3 is a side cross section of the dispensing valve cut for a small bead and in closed position.
FIG. 6 is a partial side view of the valve body as molded and taken along the line 6—6 in FIG. 7.
FIG. 7 is an end view of the valve body taken along the line 7—7 of FIG. 6.
FIG. 8 is a partial side view of the valve body as molded and taken along the line 8—8 in FIG. 7.

In FIGS. 1 and 2 the new chuck type dispensing valve is illustrated in the unopened and sealed condition. The valve consists of a body or barrel 10 and cap 12. The body 10 is affixed to a tubular cartridge 14 that is typically filled with a caulking compound or any of a wide variety of viscous materials suitable for dispensing with a caulking gun or similar means.

The cartridge 14 metal end wall hole 16 is sized to permit the valve including the cap 12 to pass through during assembly and to grip the valve body 10 at the flange 18 as shown in a conventional manner. In the figures the valve has been exaggerated in size relative to the cartridge to clarify the features of the valve, however, the normal valve size is substantially the same as conventional dispensing tips for caulking gun cartridges. An aluminized plastic seal 20 or other sealing means is affixed to the flange 18 in a conventional manner.

Figure 5:
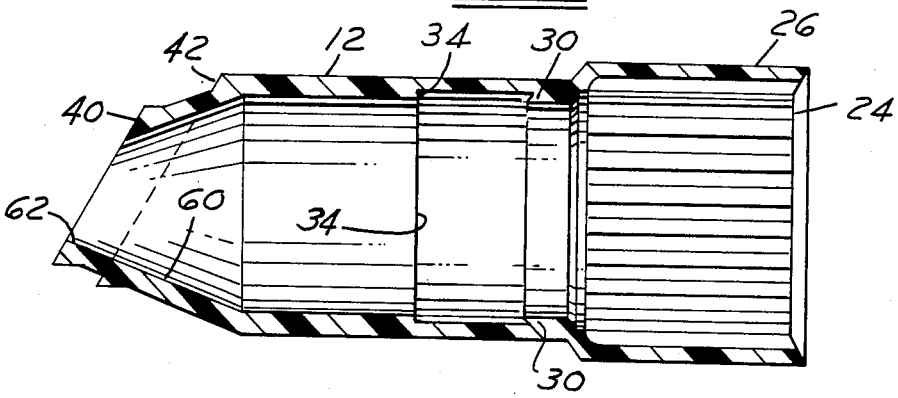
FIG. 5 is a side cross section of the cut valve cap.

The valve body 10 includes an external spline 22 formed therearound. A complementary internal spline 24 best shown in FIG. 5 is formed in the skirt 26 of the cap 12 and engages the external spline 22 to prevent rotation of the cap 12 relative to the body 10.

The cap 12 is generally cylindrical with a substantially conical tip 28 in the uncut or unopened condition. The cap 12 includes an internal integral circumferential ring and stop 30 that slideably engages the exterior surface of the body 10. In a similar manner the body 10 includes an external integral circumferential ring and stop 32 that engages the interior surface of the cap 12. The cap 12 includes a circumferential shoulder 34 spaced from the stop 32 by a circumferential gap 36 upon full closure of the uncut cap 12 on the body 10. The stop 32 is engageable with the stop 30 in the full open position as illustrated in either FIG. 4 or FIG. 9 or engageable with the shoulder 34 in the closed and cut position illustrated in FIG. 3.

The circumferential shoulder of the stop 32 facing toward the tip 28 of the valve and the circumferential shoulder of the stop 30 facing toward the flange 18 are preferably rounded or chamfered to facilitate assembly of the cap 12 to the body 10. The opposite circumferential shoulders on each stop are preferably undercut to prevent easy removal of the cap from the body once assembled. The material from which the valve is molded, typically polyethylene or polypropylene plastics, is sufficiently flexible to permit the body stop 32 to pass within the cap stop 30 during assembly of the cap to the body.

As shown in FIGS. 1 and 2 the conical tip 28 of the cap 12 completely encloses the tip 38 of the body 10 with little or no clearance space or dead air space between the cap 12 and the body 10 from the tip 28 to the shoulder 34. The circumferential stops 30 and 32 also provide a substantially airtight seal to prevent air from gaining entrance to the hollow interior of the body 10.

To initially unseal and open the dispensing valve, the tip 28 of the cap 12 is cut, simultaneously cutting the tip 38 of the body 10. Two shoulders 40 and 42 are formed on the exterior of the cap tip 28 to clearly indicate two suitable cuts providing a small opening at 40 for a small bead and a large opening at 42 for a large bead. The shoulders 40 and 42 lie in planes tilted with respect to the longitudinal axis of the valve so as to provide a bias cut 44 across both tips 28 and 38 as shown in FIG. 2. The spline engagement 22 and 24 between the cap 12 and body 10 prevents rotation of the cap 12 relative to the body 10 and thereby retains the orientation of the tip 28 to the tip 38 after cutting. As shown in FIG. 3 the valve tip is cut on shoulder 40 for the suggested smaller dispensed bead, however, the tip 38 remains closed and sealed because the cap tip 28 is molded and formed to slightly compress together the segments of the body tip 38 and the gap 36 permits the cap to be moved down the body until the shoulder 34 contacts stop 32 eliminating the gap 36. The gap is preferably about 1/32 inches in the axial direction. The tip 38 thus sticks out slightly from cap tip 28 when the cap is closed after being cut as illustrated at 39 in FIG. 3.

Referring to FIGS. 6, 7 and 8, the tip 38 of the body 10 is shown in the as molded condition before assembly to the cap. The tip 38 includes four equally spaced segments 46 about the periphery of the body 10. The segments are separated by slots 48 broadly angled 50 toward the tip end of the body and narrowly angled 52 toward the slot bottoms. The segments 46 are formed to substantially close the tip end of the hollow 54 interior of the body 10 as shown in 56 and therefore are shaped to fill quadrants within the tip 28 of the cap 12 with the cap 12 thereover as shown in FIG. 2. Although in the preferred embodiment four segments 46 are disclosed, any number of segments 46 from two on up may be utilized and the invention is not limited to a four segment valve.

Figure 4:
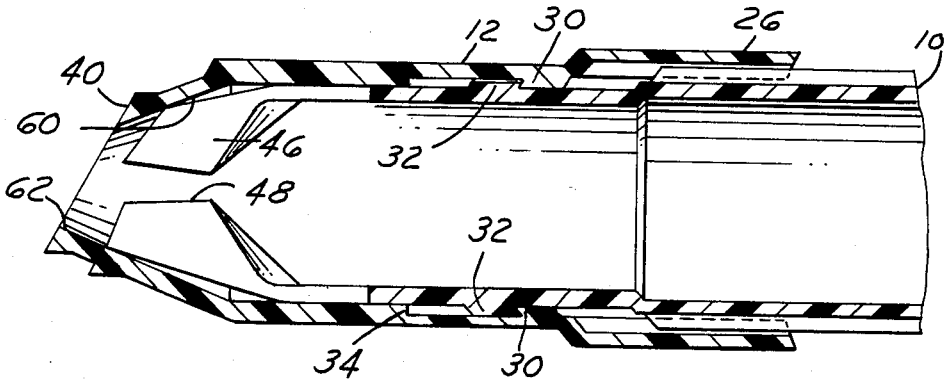
FIG. 4 is a side cross section of the dispensing valve cut for a small bead in an open position.
Figure 9:
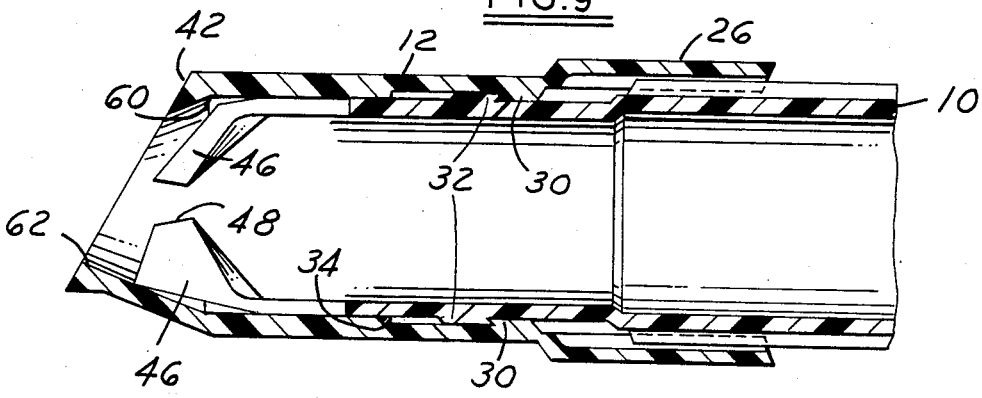
FIG. 9 is a side cross section of the dispensing valve cut for a large bead and in open position.

The slots 48 are sized and shaped at 50 to provide approximately 2° of draft or relief toward the hollow interior 54 as shown at 58 in FIGS. 2 and 3, the valve cap 12 being in either the closed uncut or closed but cut position. FIGS. 4 and 9 illustrate the positions of the cut segments 46 in the fully open cap position for the small bead cut (shoulder 40) and the large bead cut (shoulder 42) respectively. The cut segments 46 are urged and retained open against the interior surface 60 of the cap 12 by the natural resilience of the integral segments forced inwardly from the as molded shape (FIG. 6) and the flow of viscous material issuing from the valve under pressure from the cartridge and caulking gun. The viscous material flows through the slots 48 and the cut opening 62 of the tip 28 which forms a nozzle with the valve open. As the cap 12 is moved longitudinally to close the cut valve, the segments 46 are urged together and the last of the viscous material trapped in the slots 48 squeezed back into the body interior 54 by the 2° draft at 58 as the valve fully closes. Thus, the valve is fully closed with the slots 48 tightly closed at 64 on the bias cut plane at 39 as shown in FIG. 3.

Returning to FIGS. 6 and 7 it has been found that the squeezeback of material and sealing of the valve is more effective if a 2° radially outward draft is provided for the slots 48 as shown at 66. Thus, the segments 46 are 88° as shown at 68 rather than full quadrants.

The straight through design of the valve permits a nail or other sharp object to be inserted to break the seal 20. Thus, after the tip is trimmed along one of the bias planes 40 or 42 to open and the cap slid open, the nail can be inserted in the same manner as with a valveless conventional cartridge nozzle. Alternatively, a self puncturing seal 20 by means of a weak point (pin hole or perforations partly through the seal that break with caulking gun pressure) can be used.

The valve and nozzle combination as disclosed above has been directed to use with cartridges for caulking guns. The valve has much broader applicability, however, because the straight through passages permit highly viscous materials to be passed through the valve. Thus, food items such as cheese and peanut butter can be squeezed through the valve from a soft squeezable tube.

For applications where a bias cut nozzle is not needed, a helical engagement can be substituted for the spline engagement of the cap and body. The valve cap can then be turned to open and close. The resealable feature of the segments within the cap and nozzle assures that air and contaminants will be excluded from the material in the valve and tube without the need for a separate cap over the nozzle.

I claim:

1. A valve to control the flow of viscous material comprising an elongated body, a central opening extending axially substantially through the body, attachment means on one end of the body, a hollow sealed and trimmable cap retained on the other end of the body, said cap as trimmed being movable between closed and open positions relative to the body, a plurality of nestable and trimmable segments on the body and enclosed within the cap, said nestable segments as trimmed adapted to sealingly close the central opening of the body at the body end within the cap with the cap as trimmed in the closed position on the body and adapted to open an axial passage into communication with the central opening through the end of the body within the cap with the cap in the open position, and said cap as untrimmed retaining the valve sealed with the cap in the open position.

2. The valve of claim 1 wherein said segments integrally extend from the body and are resiliently urged against the inside wall of the cap.

3. The valve of claim 1 wherein the cap end encompassing the segments is substantially conical and the segments as nested form a substantially conical shape within the cap, said segments being resiliently urged against the interior wall of said cap but retained in closed position by the cap in closed position.

4. The valve of claim 1 wherein the segments are formed to provide a slight draft in the openings between the segments, said draft opening toward the central opening of the body.

5. The valve of claim 1 wherein the segments are formed to provide a slight radial draft outwardly in the openings between the segments.

6. The valve of claim 1 including indicator means on the outside of said cap to suggest at least one location to trim the cap and segments to form a nozzle, said segments resealable by movement of the cap to the closed position subsequent to trimming and openable by movement of the cap to the open position subsequent to trimming.

7. The valve of claim 6 wherein the indicator means suggest trimming the cap and segments on at least one bias plane and the cap and body include a spline engagement therebetween to prevent rotational movement of the cap relative to the body.

8. The valve of claim 6 wherein the untrimmed cap contacts the untrimmed segments and is thereby retained at a location spaced axially from the axial fully closed position of the trimmed cap on the body.

9. The valve of claim 1 wherein the cap and body include circumferential sealing means in the engagement therebetween.

10. The valve of claim 1 wherein said segments comprise four to form a cruciform shaped opening within said cap in the open position.

11. The valve of claim 1 wherein the maximum outside diameter of the cap is less than the maximum outside diamter of the elongated valve body outside of the cap.

12. A two piece valve and nozzle combination to control the flow of viscous material comprising an elongated substantially cylindrical body, a central opening extending axially substantially through the body, a plurality of nestable and trimmable segments integrally extending from one end of the body, said segments being resiliently urged apart to form passages therebetween, a substantially cylindrical trimmable cap on the body, said cap including an integral conical tip surrounding said segments and engageable therewith to control the movement of said segments apart from one another and said cap as untrimmed retaining the valve sealed with the cap in an open position, a spline on said body and a complementary spline on said cap engaged therewith, said spline engagement restricting the movement of the cap relative to the body to axial movement, and cap sealing and stop means comprising at least one circumferential stop extending between the valve body exterior and the cap interior, said cap as trimmed movable between the open position and a fully closed position defined by said circumferential stop.

13. The valve and nozzle combination of claim 12 wherein the cap and segments are trimmable together to selectably form the nozzle.

14. The valve and nozzle combination of claim 13 wherein the untrimmed cap is axially spaced from the fully closed position by contact with the untrimmed segments.

15. The valve and nozzle combination of claim 13 wherein the trimmed segments extend beyond the trimmed cap with the cap in the fully closed position.

16. The valve and nozzle combination of claim 12 including an additional pair of circumferential stops, said stops including mutually engaging undercut surfaces to prevent disassembly of the cap from the body.

17. The valve and nozzle combination of claim 12 wherein the passages between segments include axial draft widening toward the central opening of the body.

18. The valve and nozzle combination of claim 12 wherein the passages between segments include radially outward draft.

19. The valve and nozzle combination of claim 12 wherein said segments comprise four to form a cruciform shaped passageway upon opening of the valve.

* * * * *